United States Patent [19]

Overend

[11] 3,999,652

[45] Dec. 28, 1976

[54] HYGIENIC PHLEBOTOMIST'S TRAY

[76] Inventor: Thomas F. Overend, 4379 Dart Ave., Minneapolis, Minn. 55424

[22] Filed: Mar. 5, 1976

[21] Appl. No.: 664,291

[52] U.S. Cl. ..... 206/216; 206/459; 220/65; 242/67.3 R; 206/557

[51] Int. Cl.[2] ..... B65D 1/34; B65D 25/20

[58] Field of Search ..... 206/72, 216, 225, 459, 206/; 220/63 R, 65; 108/26, 30, 50; 312/140.4; 242/67.1 D, 67.3 R, 67.4

[56] References Cited

UNITED STATES PATENTS

| | | | |
|---|---|---|---|
| 1,237,170 | 8/1917 | Cline | 312/140.4 X |
| 2,688,818 | 9/1954 | Joy | 108/50 |
| 3,249,070 | 5/1966 | Day et al. | 108/26 |

FOREIGN PATENTS OR APPLICATIONS

| | | | |
|---|---|---|---|
| 187,803 | 7/1907 | Germany | 108/50 |

*Primary Examiner*—William Price
*Assistant Examiner*—Stephen Marcus
*Attorney, Agent, or Firm*—H. Dale Palmatier

[57] ABSTRACT

A hygienic phlebotomist's tray for restraining the spread of contamination such as blood, phlegm, etc., and hence reducing disease transmission as the tray is transported by a phlebotomist from patient to patient in a hospital. Fresh lengths of sheet material are consecutively advanced beneath the tray as the phlebotomist moves to consecutive patients, the sheet material protecting the bottom of the tray from contact with contaminated surfaces such as overhanging bed tables. A take up roll winds up the thus-contaminated lengths of sheet material with the contaminated side of the material facing inwardly of the take up roll.

11 Claims, 6 Drawing Figures

FIG. 6
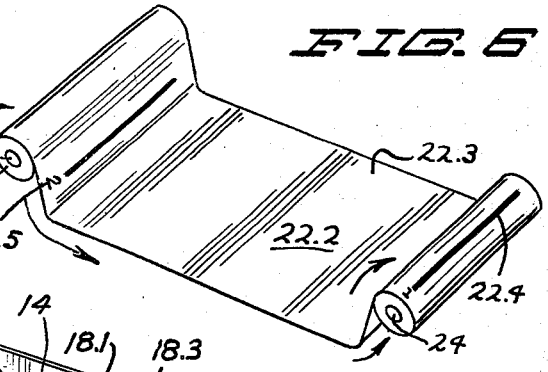
FIG. 1
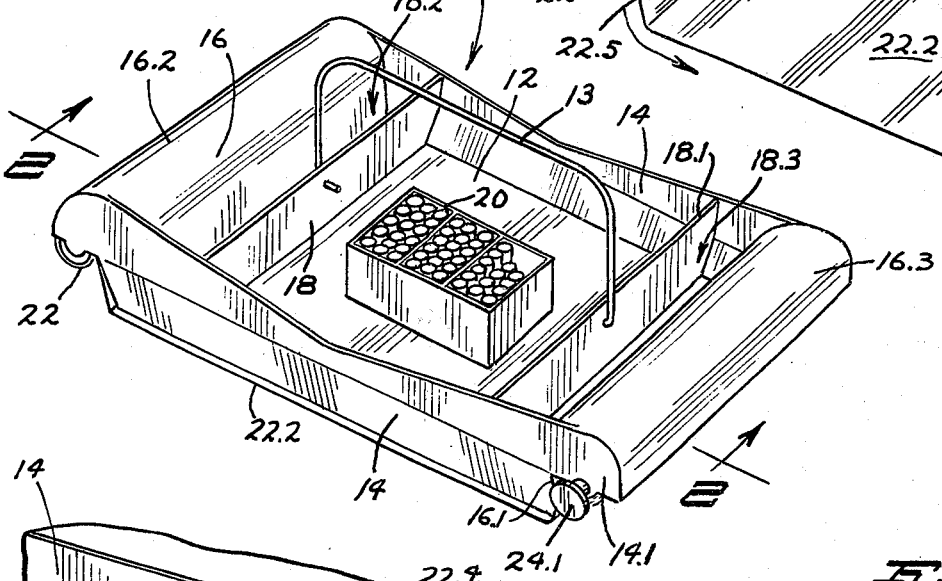
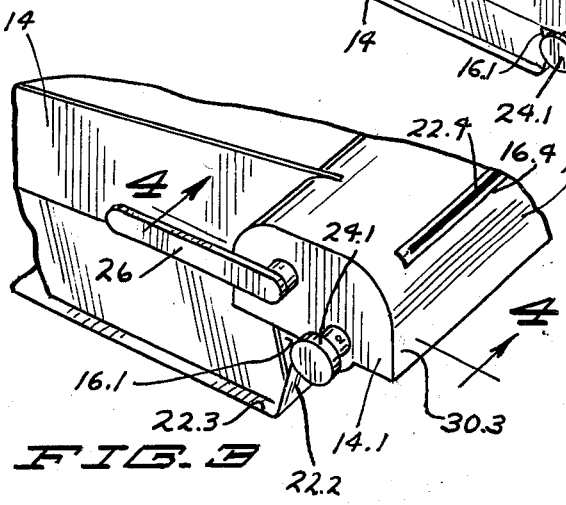
FIG. 3
FIG. 4
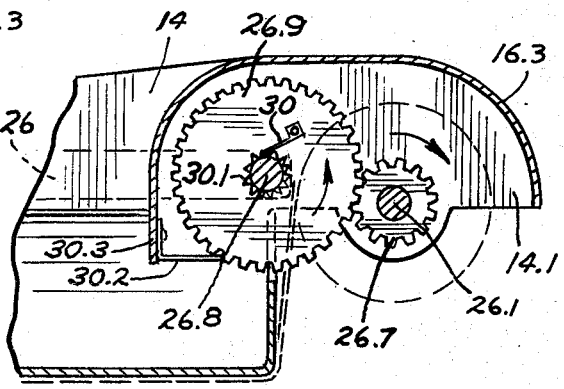
FIG. 5
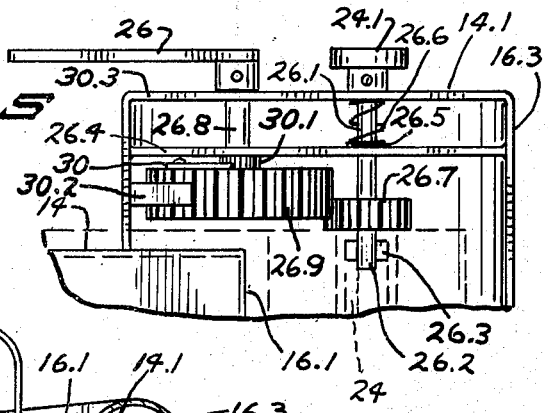
FIG. 2
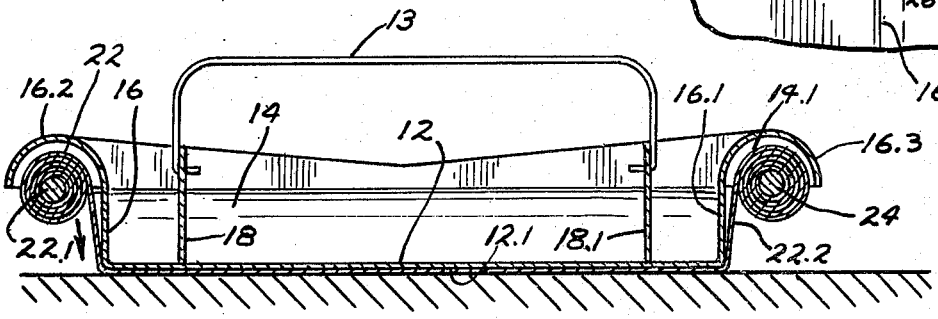

HYGIENIC PHLEBOTOMIST'S TRAY

BACKGROUND OF THE INVENTION

In the practice of medicine in hospitals, blood samples are routinely taken from patients by such personnel as medical technologists (hereinafter, "phlebotomists"), which blood samples are then analyzed to afford a variety of test results such as the concentration levels of various chemicals or other substances in the blood. The hypodermic syringes and bottles and like equipment used in blood sampling are commonly carried in a tray which is transported from patient to patient by the phlebotomist as the latter moves through a hospital. When preparing to draw blood from a patient, the phlebotomist places the equipment tray on a bedside stand or an overhanging bed table, or on the bed itself, which surfaces, it will be understood, may often be highly contaminated with, for example, blood, phlegm, mucus, urine and feces from urinals and bed pans, scraps of food, spilled beverages, etc. The movement in this manner of the tray from patient to patient, it will be understood, may well serve to transmit diseases from patient to patient.

Modern hospitals are acutely aware of the problem of disease transmission from patient to patient, and well-run hospitals take extreme care to prevent or reduce such disease transmission. For example, thermometers are thoroughly sterilized or are provided with disposable cases which are thrown away after each use. Great care is taken with the sterilization of surgical instruments. The personal cleanliness of hospital personnel is carefully monitored, and germicidal soaps and the like are regularly employed. Yet, disease transmission within hospitals remains an acute problem, and every person or thing which moves from patient to patient is a potential carrier of disease.

SUMMARY OF THE INVENTION

The present invention provides a portable, hygienic phlebotomist's tray for restraining disease transmission as the tray is transported from patient to patient in a hospital by a phlebotomist. The tray comprises a carrier having a bottom wall with a supporting lower surface, and opposing side walls and end walls defining a pan for carrying phlebotomy instruments such as hypodermic needles and the like. Parallel feed and take up rolls are provided at opposite ends of the pan, with the take up roll exterior of the pan. The feed roll is provided with a supply, in roll form, of sheet material which extends from the feed roll protectively along the bottom surface of the bottom wall of the pan to the take up roll. Means are provided for winding the take up roll to advance and wind up the sheet material with the downwardly exposed surface of the sheet material as it passes beneath the pan becoming the inward facing surface of the sheet material as it is wound onto the take up roll. As a result, when the tray is rested on a contaminated surface such as a bed-side table or the like, only the sheet material itself contacts the table. A fresh length of sheet material from the feed roll is advanced by the phlebotomist beneath the pan as the latter is carried from one patient to the next. The lengths of sheet material which have been in contact with the bedside table or the like, and which may be considered contaminated, are wound up onto the take up roll with the contaminated surface of the sheet material facing the inside of the roll. When all of the sheet material supply has been wound onto the take up roll, the roll of sheet material may be removed from the tray and destroyed by incineration or the like.

The pan itself is of fiberglass or other heat-stable material which is light to carry and which can withstand repeated autoclaving. The sheet material may be paper or plastic film or the like which is resistant to the transmission therethrough of microorganisms. That side of the sheet material which is upwardly facing when the sheet material is beneath the tray may be provided with length marks, the latter then appearing on the outside of the sheet material as it is wound on a take up roll to indicate that the latter has been sufficiently wound to advance a full, fresh length of paper beneath the tray. The sheet material is dimensioned so as to extend beyond the periphery of the bottom of the tray and to thus fully protect the bottom of the tray from any encounter with a bed-side stand or the like upon which it may be rested.

DESCRIPTION OF THE DRAWING

FIG. 1 is a perspective view of a phlebotomist's tray of the invention;

FIG. 2 is a cross-sectional view taken along line 2—2 of FIG. 1;

FIG. 3 is a broken away view, in partial cross section, showing a portion of a modification of the tray of FIG. 1.

FIG. 4 is a broken away view, in partial cross section taken along line 4—4 of FIG. 3;

FIG. 5 is a broken away bottom view, in partial cross section of the tray shown in FIG. 4; and FIG. 6 is a diagramatic, perspective view showing the protective sheet material and the direction of travel thereof as the same is used with a tray of the invention.

DETAILED DESCRIPTION OF THE INVENTION

In FIG. 1, a phlebotomist's tray of the invention is designated generally as 10 and includes a bottom wall or floor 12, opposing side walls 14 and opposing end walls 16, 16.1, the floor and walls forming an upwardly open pan or carrier for carrying hypodermic needles or containers of bottles or the like as shown generally by 20 in FIG. 1. The upper ends of the end walls 16, 16.1 may extend outwardly and downwardly as shown at 16.2, 16.3, and the end walls may be formed integrally with the bottom wall 12 as shown in FIG. 2. The lower surface 12.1 of the bottom wall is generally flat so as to support the tray upon a flat surface such as the top of a bed-side table or the like. It will be understood that the bottom surface 12.1 of the tray may be provided with small lugs or feet or the like if desired.

With particular reference to FIGS. 1, 2 and 6, the tray is provided with a supply roll 22 of paper or other sheet material, the supply roll being mounted on a cardboard core or similar spool-like center and carried adjacent one end wall 16 of the tray. The side walls 14 of the tray may extend outwardly slightly from the end wall 16, as shown at 14.1, and may form, with the outwardly and downwardly curved portions 16.2, 16.3 of the end walls, a downwardly open roll receptacle. With respect to the supply roll 22, the adjacent, outwardly extending side wall portions may be provided with inwardly projecting lugs which are received within the open ends of the supply roll core 22.1. The slightly springy characteristics associated with thin-walled containers, such as those made of fiberglass, permit the exterior end portions of the side walls to be spread slightly to enable the supply roll core to be inserted and removed.

Adjacent the other end wall 16.1 of the tray, and exterior of the tray, is mounted a take up roll or spool, designated generally as 24. The take up roll is received between the adjacent side wall extensions 14.1 and within the downwardly-open roll receptacle formed by the side wall extensions and the outwardly and downwardly curved end wall extension 16.3. The spool 24 may consist of a cardboard tube or other appropriate core upon which paper may be rolled.

The paper 22.2 is drawn from the supply roll 22 downwardly and then across the bottom surface 12.1 of the tray and thence upwardly again at the other end of the tray to be taken up by the take up roll 24. The latter roll is provided with means for manually turning, or rotating, the roll so as to roll up the paper thereon and concurrently to draw more paper from the supply roll 22 across the bottom surface of the tray. The means for rotating the take up roll 24 may cause the roll to be rotated in such a direction that the bottom surface of the paper as it passes beneath the tray becomes the inwardmost facing surface of the paper as it is rolled on the take up roll; this direction of rotation is clockwise as shown in FIGS. 2, 4 and 6. The side wall extensions 14.1 which, with the end wall extension 16.3 forms a downwardly-open roll receptacle, may have inwardly projecting lugs or projections which are received within the ends of the take up roll. One of the projections may itself be rotatable, and may extend through the adjacent side wall projection and terminate outwardly in a knob 24.1 which can be turned by a phlebotomist to advance paper beneath the tray.

FIGS. 3, 4 and 5 show a windup mechanism for the take up roll 24 in which the take up roll may be advanced by movement of an exterior lever 26. As shown in FIG. 5, a take up shaft 26.1 extends through the side wall projection 14.1 and has an exterior end terminating in a knob 24.1 and an interior end 26.2 adapted to be inserted in the open end of a hollow cardboard core or the like employed as the roller 24. The inner end 26.2 is provided with transverse lugs 26.3 which are shaped to be received in small axial slots formed in the end of the cardboard core to rotationally lock the core to the shaft 26.1. An interior wall 26.4 is spaced inwardly of, but parallel to, the outer side wall extension 14.1, and the shaft 26.1 extends through aligned holes in both walls and is rotatably supported by the walls. A stop, such as disc 26.5, is mounted to the shaft between the walls 14.1, 26.4. A helical compression spring 26.6 is mounted on the shaft between the walls 14.1 and 26.4, and bears against the outer wall 14.1 and the stop 26.5 so as to urge the stop and the shaft to which it is attached inwardly. Fixed to the shaft inwardly of the auxiliary wall 26.4 is a toothed gear 26.7.

The exterior lever 26 is mounted to a shaft 26.8 which is rotatably mounted to the side wall 14.1 of the tray and extends therethrough parallel to the shaft 26.1. The shaft 26.8 is provided with a toothed gear 26.9 which is comparatively large in comparison to the gear 26.7 and which meshes with the latter gear to drive the same. It will be understood that as the lever 26 in FIGS. 3 and 4 of the drawing is cranked downwardly toward the bottom of the tray, the take up shaft 26.1 is rotated in a clockwise direction (FIG. 4). Clutch means, such as the ratchet and pawl mechanism shown in FIG. 4, is provided so that the gear 26.9 is rotated in only one direction by the lever. The spring steel pawl 30 is fixed to the gear 26.9 at one end and has its other end extending inwardly for contact with a toothed portion 30.1 of the shaft 26.8. Further, a second pawl 30.2, mounted to the gear housing 30.3 formed as an extension of the outwardly and downwardly curved end 16.3, bears against the gear 26.9 to prevent the latter from turning as the lever is cranked in an upwardly (FIG. 4) direction. In this manner (referring to FIG. 4), the lever 26 may be cranked up and down with the take up roll 24 rotating during the down stroke of the lever, but remaining during the up stroke of the lever.

As shown best in FIGS. 1 and 2, the side walls 14 of the tray converge slightly at their lower ends so that the side-to-side width of the bottom wall 12 is less than the width of the paper 22.2 passing therebeneath. In this manner, the longitudinal edges of the paper 22.2 protrude outwardly slightly from the sides of the bottom wall 12.

Referring now to FIGS. 3 and 6, a longitudinal viewing slot or window 16.4, which is transverse to the direction of travel of the paper, is provided in the outwardly turned end wall portion 16.3 which shelters the take up roll 24. The inner surface 22.3 of the paper (that is, the surface of the paper facing upwardly as it is drawn across the bottom of the tray) may be imprinted with indicia relating to the number of lengths of paper which have been drawn across the bottom wall of the tray, or to the distance between such lengths of paper, or both. As shown in FIG. 6, such indicia comprise a transverse line or mark 22.4, and also a numeral such as shown at 22.5, with the mark and numeral being so positioned as to become visible through the slot or window 16.4 as the paper is advanced across the bottom surface of the tray. If desired, a slot or window may be provided in the other end wall extension 16.2 for viewing the indicia, or one or both end wall extensions 16.2, 16.3 may be omitted to expose the sheet material, the latter having indicia on an upwardly exposed surface.

The sheet material 22.2 employed in the present invention, referred to sometimes as "paper" herein, may be any sheet material which is reasonably resistant to the transmission therethrough of disease microorganisms. Such sheet material may consist of various grades of paper, plastic film, or the like. A dense paper, such as "butcher" wrapping paper or waxed or otherwise impregnated paper is desired. Particularly, the paper should be substantially waterproof or water resistant so that aqueous contamination such as blood, urine, etc. does not readily soak through.

The tray may be provided internally with transverse walls 18, 18.1 which are parallel to the end wall 16, 16.1 and which are spaced interiorly thereof a short distance. The walls 18, 18.1 divide the tray into working areas, the central portion of which may include sealed bottles or the like as shown at 20. That portion of the tray between the walls 16 and 18, and designated 18.2 is nearest the supply roll 22, and may be considered a somewhat more sterile area than the area between the walls 18.1, 16.1. The latter area, termed 18.3, may be considered the disposal area in which hypodermic syringes, cotton swabs and the like may be placed after use. The area 18.2, on the other hand, serves as a convenient storage place for sterile syringes, swabs and the like.

As shown in FIGS. 1 and 2, a bail-type handle 13 is shown, the ends of the U-shaped handle being hooked through small holes in the walls 18, 18.1 so that the handle may be moved from a carrying position as shown in the drawing to a working position in which the handle is moved to one side of the tray or the other to fully expose the central working portion of the tray. If desired, a pair of handles similar to that shown in FIG. 1 may be employed, the handles being spaced from one another and joined to the walls 18, 18.1 adjacent the side walls 14. The upper portions of such handles are brought together above the tray so that the latter may be carried with one hand, the other hand operating the lever 26 as the tray is carried from one patient to another. The use of a pair of handles in this manner reduces tipping of the tray. Other ways of providing tray handles will suggest themselves to those skilled in the art.

To prepare the tray of the invention for use, a take up roll, which may be of tubular cardboard or the like, is first inserted within the recess formed by the side wall extensions 14.1 and the covering end wall 16.3. This may be accomplished by drawing the knob 24.1 outwardly slightly against the pressure of the spring 26.6, and then inserting the cardboard tube so that the shaft end 26.2 is inserted in the end of the tube and the lugs 26.3 engage axial slots in the tube to rotationally lock the tube to the shaft. When the button 24.1 is released, the shaft is spring-urged inwardly against the roll 24. The toothed gear 26.7, which may be narrower than the gear 26.9, permits the gears to remain meshed and yet move axially of one another. A supply roll of paper, designated 22, may then be appropriately attached to the end of the tray adjacent the end wall 16, as described above, and the free end of the paper is drawn downwardly and beneath the bottom surface of the tray and then upwardly for attachment to the take up roll. It is contemplated that the paper rolls may be supplied with the end of the paper preattached to an accompanying take up roll.

The tray, thus prepared, may be carried from patient to patient by a phlebotomist. A fresh length of paper is advanced by the phlebotomist beneath the tray after each patient has been visited. The indicia 22.4, 22.5 carried by the paper serve to indicate to the phlebotomist when a complete fresh length of paper has been advanced beneath the tray. The numerical indicia 22.5 carried by the paper may provide a cautionary check to assure that the phlebotomist has advanced a fresh sheet of paper for each patient visited. Upon return to the laboratory following hospital rounds, the remainder of the paper on the supply roll 22 is advanced beneath the tray and is wound on the take up roll 24. By withdrawing the button 24.1, the take up roll may be removed and destroyed by burning, the excess length of fresh paper wound on the roll further serving to protect the phlebotomist's hand from contamination carried by the paper internally of the roll. The hollow cardboard core or the like of the supply roll 22 may similarly be discarded, or may be employed as the take up roll for the next series of visits. The tray, with its contents, cardboard rolls and paper removed, may then be subjected to sterilization by known means.

As mentioned above, the tray may be made of fiberglass or other heat resistant plastic, or may be made of stainless steel or other material capable of withstanding heat sterilization procedures. Fiberglass, molded into the desired shape, is desired because of its lightness, its resistance to heat and bacterial growth, its electrical nonconductance, and its ability to withstand sharp blows without shattering or denting. If means for rapidly transporting lengths of paper are employed, such as the gear and lever assembly shown in the drawing, it is desired that these items also be of temperature resistant materials. The internal, working area of the tray may be on the order of 12 inches wide and 15 inches long. The paper or other sheet material which is employed desirably protrudes from the tray bottom at least about 1/4 inch on either side of the tray. Assuming that 15 different patients are visited during a single hospital round, the supply roll should contain 225–240 continuous inches of paper in length to permit the paper to be advanced at least 15 times.

Thus, manifestly, I have provided a hygienic phlebotomist's tray for restraining the spread of contamination and hence reducing disease transmission as the tray is transported from patient to patient in a hospital. The protective paper or other sheet material prevents the tray body itself from coming into contact with contaminated surfaces, and the paper which itself becomes contaminated is wound up with its contaminated surface facing protectively inwardly. Means are provided for advancing the sheet material rapidly, and also for indicating when a complete sheet length has been advanced.

While I have described a preferred embodiment of the present invention, it should be understood that various changes, adaptations, and modifications may be made therein without departing from the spirit of the invention and the scope of the appended claims.

What is claimed is:

1. A portable, hygienic phlebotomist's tray for restraining disease transmission as the tray is transported from patient to patient in a hospital by a phlebotomist, the tray comprising a carrier having a bottom wall and opposing side and end walls defining a pan for carrying phlebotomy instruments; parallel, spaced feed and take up rolls at opposite ends of the pan with the take up roll exterior of the pan, the feed roll bearing a supply, in roll form, of sheet material extending from the feed roll protectively along the bottom surface of the bottom wall of the tray to the take up roll, and means for winding the take up roll to advance and wind up the sheet material with the downwardly exposed surface of the sheet material as it passes beneath the pan becoming the inwardly facing surface of the sheet material as it is wound onto the take up roll, whereby as the tray is rested on a contaminated surface such as a bed-side table, only the sheet material contacts the table, a fresh length of sheet material from the feed roll being advanced by a phlebotomist beneath the pan as the latter is carried from one patient to the next.

2. The phlebotomist's tray of claim 1 wherein the width of the bottom surface of the pan transverse of the direction of travel of the sheet material is less than the transverse width of the sheet material, whereby the sheet material extends beyond the periphery of the bottom of the pan to shield the pan from contamination by a surface upon which it may be rested.

3. The phlebotomist's tray of claim 1 including means permitting rotation of the windup roll in a single direction.

4. The phlebotomist's tray of claim 1 wherein said winding means includes manually operable means exteriorly of the pan for operation by a phlebotomist for winding the take up roll.

5. The phlebotomist's tray of claim 4 wherein the manually operable means comprises an exterior, rotatable knob mounted to the windup roll.

6. The phlebotomist's tray of claim 4 wherein the manually operable means comprises an exterior, manually operable lever pivotally mounted to the pan, and gear means connecting the lever and the take up roll for winding the latter in response to operation of the lever.

7. The phlebotomist's tray of claim 1 wherein the sheet material includes visible indicia dividing the sheet material into successive lengths of material to be advanced beneath the pan as the latter is carried between successive patients.

8. The phlebotomist's tray of claim 7 wherein the pan includes a protective cover covering the take up roll from above, the cover having an opening through which said visible indicia may be viewed.

9. A portable, hygienic phlebotomist's tray for restraining disease transmission as the tray is transported from patient to patient in a hospital by a phlebotomist, the tray comprising a carrier having a bottom wall with a supporting lower surface, and opposing side walls and end walls defining a pan for carrying phlebotomy instruments; parallel, spaced feed and take up rolls at opposite ends of the pan with the take up roll exterior of the pan and the feed roll bearing a supply, in roll form, of water-resistant sheet material extending from the feed roll protectively along the bottom surface of the bottom wall of the pan to the take up roll; unidirectional winding means for winding the take up roll to advance and windup successive lengths of sheet material thereon with the downwardly exposed surface of the sheet material as it passes beneath the pan becoming the inwardly facing surface of the sheet material as it is wound onto the take up roll, the tray including, adjacent the take up roll, an elongated, downwardly-open cover housing the take up roll.

10. The hygienic phlebotomist's tray of claim 9 wherein the sheet material includes visible indicia dividing it longitudinally into successive, unbroken lengths to be advanced beneath the pan as the latter is carried between successive patients, said indicia being provided on that surface of the sheet material which is upwardly visible to the phlebotomist as the material is unwound from the supply roll or taken up on the take up roll.

11. The phlebotomist's tray of claim 10 wherein said indicia provided on that surface of the sheet material which is upwardly facing as the material passes beneath the tray, and wherein said cover includes a viewing port through which the indicia may be viewed as the material is wound onto the take up roll.

* * * * *